US008341974B2

(12) United States Patent
Oh et al.

(10) Patent No.: US 8,341,974 B2
(45) Date of Patent: Jan. 1, 2013

(54) REFRIGERATOR AND METHOD OF CONTROLLING THE SAME

(75) Inventors: Min Kyu Oh, Seoul (KR); Kyeong Yun Kim, Seoul (KR); Jang Seok Lee, Seoul (KR); Youn Seok Lee, Seoul (KR); Su Nam Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 713 days.

(21) Appl. No.: 12/547,038

(22) Filed: Aug. 25, 2009

(65) Prior Publication Data

US 2010/0126205 A1 May 27, 2010

(30) Foreign Application Priority Data

Nov. 26, 2008 (KR) ..... 10-2008-0118215

(51) Int. Cl.
*F25D 17/04* (2006.01)
*F25D 11/02* (2006.01)

(52) U.S. Cl. ..... 62/187; 62/186; 62/441

(58) Field of Classification Search ..... 62/408, 62/441, 442, 446, 186, 187; 700/275
See application file for complete search history.

(56) References Cited

FOREIGN PATENT DOCUMENTS

| | | | |
|---|---|---|---|
| EP | 1 074 802 A2 | | 7/2000 |
| EP | 1 621 831 A1 | | 7/2004 |
| JP | 4244569 | | 9/1992 |
| JP | 2001116421 A | * | 4/2001 |
| JP | 2004061097 A | * | 2/2004 |
| JP | 2005-083628 A | | 3/2005 |
| JP | 2007255740 A | * | 10/2007 |
| JP | 2007-292333 A | | 11/2007 |
| KR | 2004-0086894 A | | 10/2004 |

OTHER PUBLICATIONS

International Search Report and Written Opinion dated Oct. 28, 2010.

* cited by examiner

*Primary Examiner* — Chen Wen Jiang
(74) *Attorney, Agent, or Firm* — KED & Associates, LLP

(57) ABSTRACT

A refrigerator is provided. The refrigerator may include a cold air generation chamber provided in a body of the refrigerator, the cold air generation chamber having an evaporator installed therein. A cold air duct may form a path through which cold air generated in the cold air generation chamber is circulated to a freezer compartment, and a quick freezer compartment. The quick freezer compartment may be connected with the cold air duct, and may be positioned substantially nearer to the evaporator than the freezer compartment. A damper may be installed in the cold air duct to selectively shut off the flow of cold air to the freezer compartment. The quick freezer compartment may be quickly cooled using cold air directly supplied from the cold air generation chamber. Furthermore, cold air may be directed into the quick freezer compartment by selectively shutting off the supply of cold air into the freezer or refrigerator compartment.

12 Claims, 9 Drawing Sheets

REFRIGERATOR AND METHOD OF CONTROLLING THE SAME

CROSS REFERENCE TO RELATED APPLICATION

This application claims the benefit of Korean Patent Application No. 10-2008-0118215, filed in Korea on Nov. 26, 2008, the entirety of which is incorporated herein by reference.

BACKGROUND

1. Field

A refrigerator is provided, and in particular, a refrigerator capable of cooling or preserving food items at low temperatures, and a method of controlling such a refrigerator, are provided.

2. Background

Refrigerators are electric appliances capable of cooling or freezing food stuffs using cold air generated by a phase-change of a refrigerant, or a working fluid. Such a refrigerator may include a body having refrigerator and freezer compartments formed therein, and refrigerator compartment and freezer compartment doors rotatably coupled to the body to open and close respective front openings of the refrigerator and freezer compartments. Various components of a freezing cycle process refrigerant to provide for cooling of the refrigerator and freezer compartments of the refrigerator. Certain storage items would benefit from a more rapid cooling rate in at least a portion of the refrigerator or freezer compartment.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to specific embodiments, examples of which are illustrated in the accompanying drawings. Wherever possible, the same reference numbers will be used throughout the drawings to refer to the same or like parts.

A freezing cycle of a refrigerator may include a compressor that compresses low temperature/pressure gaseous refrigerant into a high temperature/pressure gaseous refrigerant, a condenser that condenses the refrigerant drawn from the compressor using external air, an expansion valve having a relatively narrow diameter that expands the refrigerant drawn from the condenser, and an evaporator that absorbs the heat generated while the refrigerant that has passed through the expansion valve is evaporated at a low pressure.

Refrigerators may be categorized into, for example, top mount types and side by side types. In the top mount type, the refrigerator an freezer compartments are mounted one on top of the other, with refrigerator and freezer doors respectively coupled to the compartments to open and close the compartments. In the side by side type, the refrigerator and freezer compartments are provided side by side, with refrigerator and freezer compartment doors rotatably coupled to two opposite sides of the refrigerator to open and close the respective compartments.

Various kinds of convenient features, such as, for example, a home bar or a dispenser that allows a user to remove items from the refrigerator without opening the doors may be provided in the doors.

In addition, a quick freezer compartment may be provided in/with the freezer compartment or the refrigerator compartment for the rapid freezing of food items. Similarly, a quick cooling chamber may be provided in/with the freezer compartment or the refrigerator compartment to quickly cool items such as, for example, beverages. However, the use of an auxiliary evaporator dedicated to the cooling of only the quick freezer compartment or the quick cooling compartment may adversely affect product cost.

Figure 1:
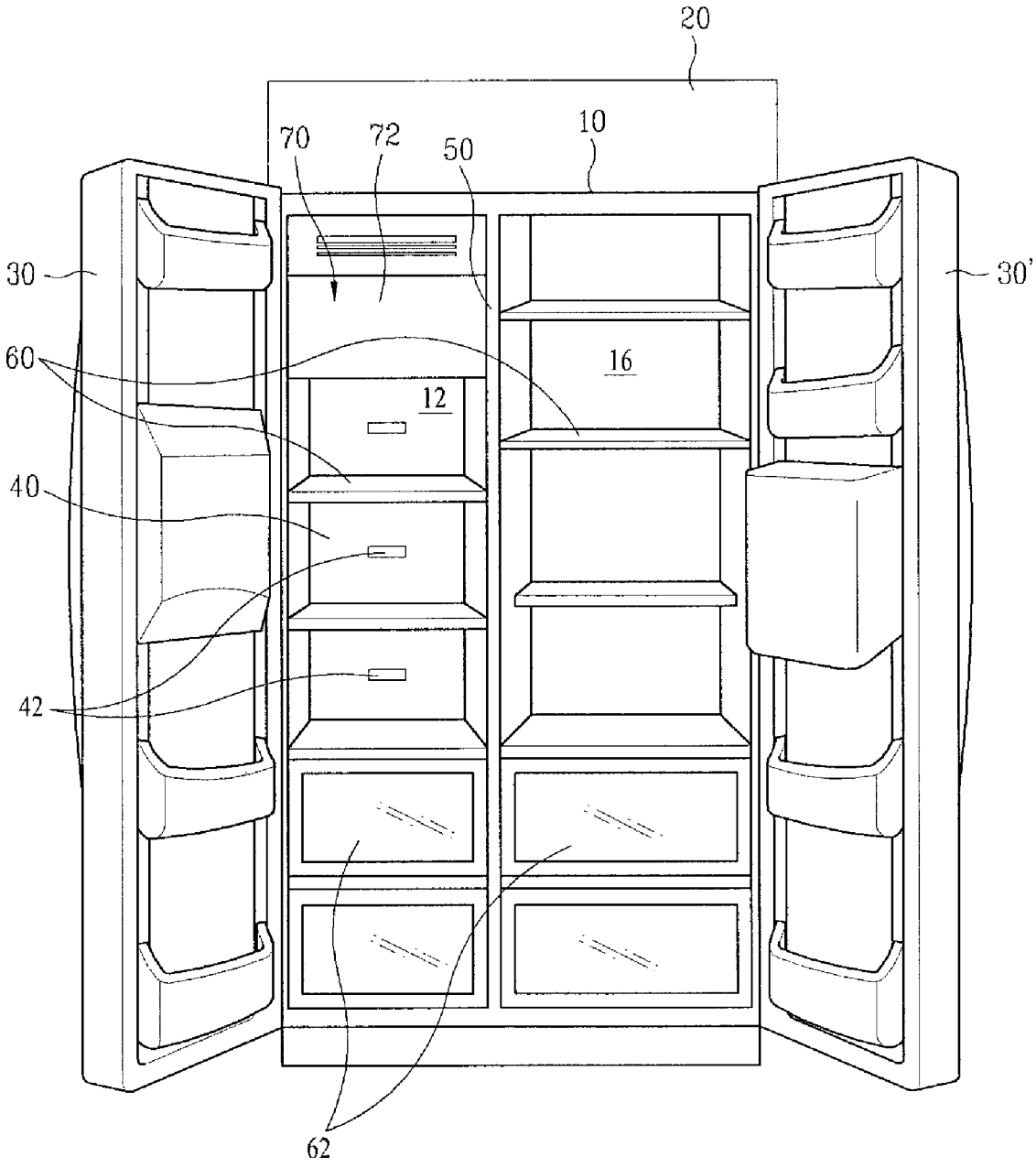
FIG. 1 is a perspective view an exemplary refrigerator in accordance with an embodiment as broadly described herein.

The exemplary refrigerator shown in FIG. 1 may include freezer and refrigerator compartments 12 and 16 provided in a body 10 which defines an exterior appearance of the refrigerator. The body 10 is partitioned by a partition wall 50 into the freezer and refrigerator compartments 12 and 16, which form storage spaces within the refrigerator in which food items may be cooled and preserved using cold air generated by an evaporator 150 (to be described later).

A mechanism compartment 20 may be provided in the body 10. Although in the embodiment shown in FIG. 1 the mechanism compartment 20 is provided at an upper portion of the body 10, it may be provided at a lower portion of the body 10, or at another position as appropriate. A compressor 110, a condenser 120 and a fan motor assembly (not shown) of the freezing cycle may be provided in the mechanism compartment 20. In addition, a cold air generation chamber 22 may also be provided in the mechanism compartment 20. The evaporator 150 may be installed in the cold air generation chamber 22, and the cold air generation chamber 22 may communicate with a cold air duct 80 to be described later.

Doors 30 and 30' may be respectively coupled to fronts of the freezer and refrigerator compartments 12 and 16. The doors 30 and 30' may be formed in a predetermined shape corresponding to the refrigerator or freezer compartment 12 or 16 so as to define an exterior appearance of a front of the refrigerator. The doors 30 and 30' may be rotatably coupled to the body 10 such that the doors 30 and 30' may open and close front openings of the freezer and refrigerator compartments 12 and 16. As a result, the doors 30 and 30' may selectively open or close the refrigerator or freezer compartment 12 or 16 to provide access to food items in the refrigerator.

Figure 7A:
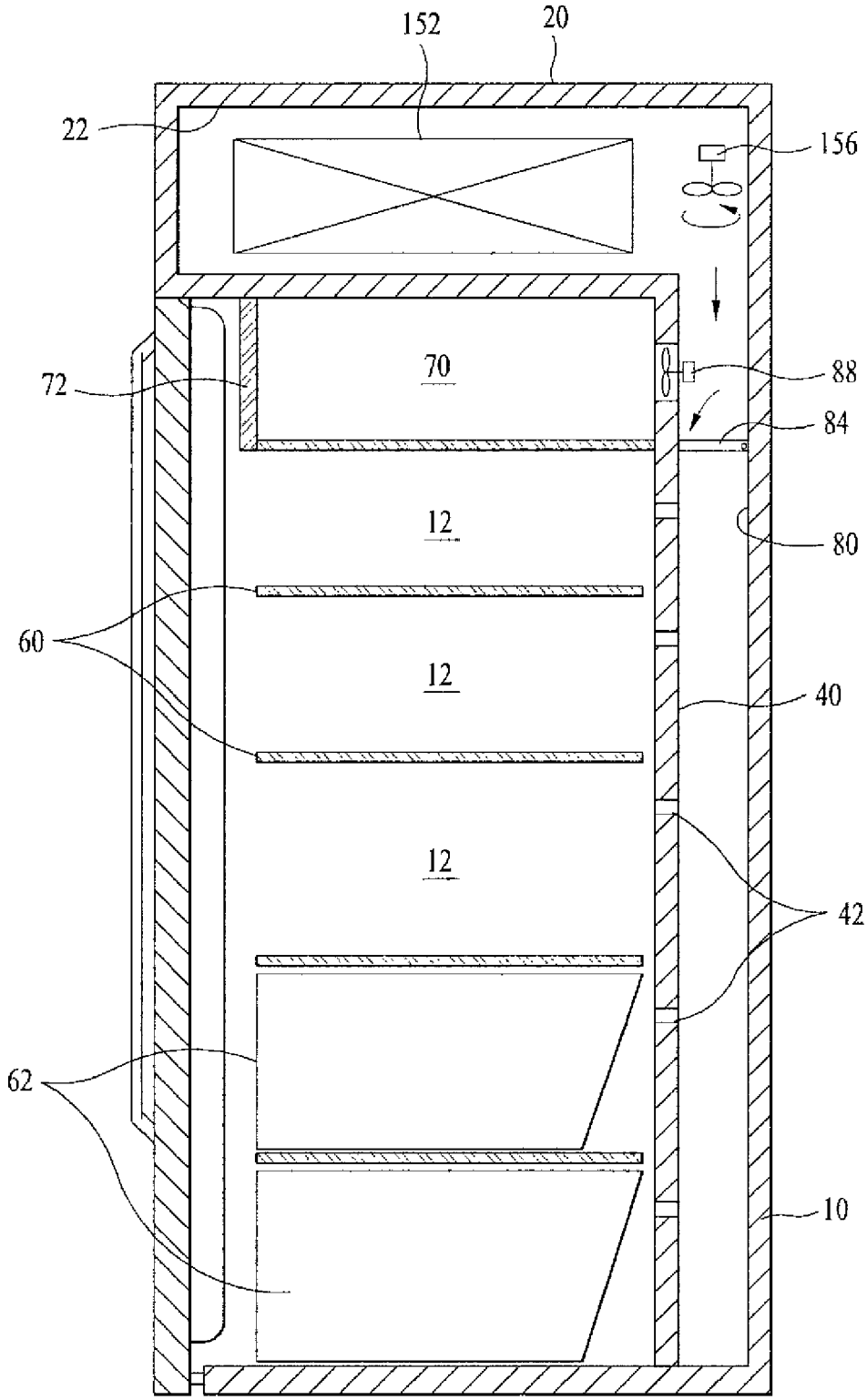
FIGS. 7A to 7C are side sectional views of air flow paths of the refrigerator shown in FIG. 1.
Figure 7B:
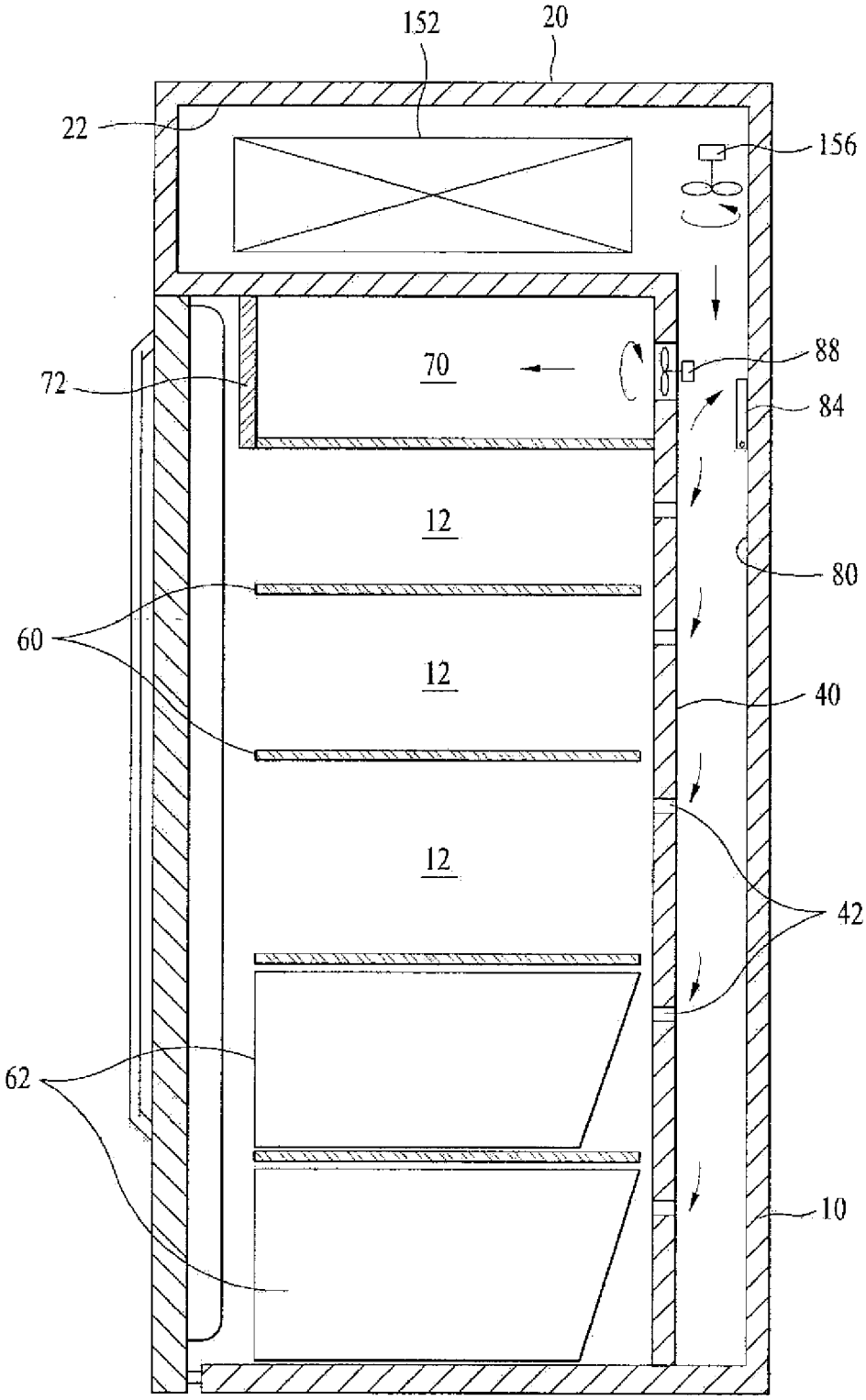
Figure 7C:
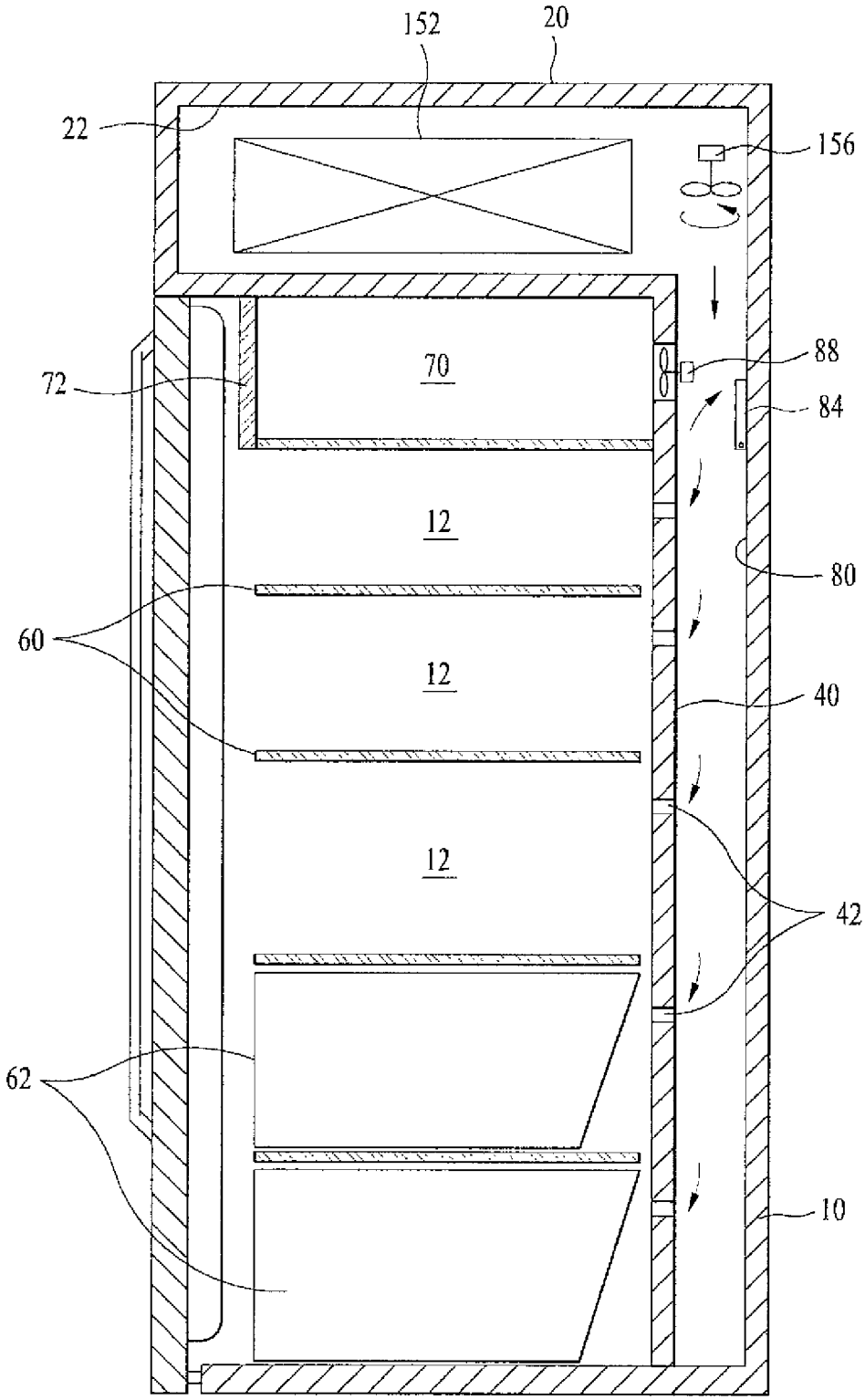

A barrier 40 may be provided near a rear of the body 10 to separate the cold air duct 80 from the freezer and refrigerator compartments 12 and 16. That is, the barrier 40 may partition off the separate cold air duct from the freezer and refrigerator compartments 12 and 16. As shown in FIGS. 7A-7C, the barrier 40 may extend vertically between a bottom and a top of the body 10.

At least one cold air outlet 42 may be formed in the barrier 40. The at least one cold air outlet 42 may be, for example, at least one hole in the barrier 40 through which cold air from the cold air duct 80 may be discharged into the freezer and refrigerator compartments 12 and 16.

The partition wall 50 may partition the storage space formed in the body 10 into the freezer compartment 12 and the refrigerator compartment 16. In the embodiment shown in FIG. 1, the partition wall 50 extends vertically between the bottom and the top of the body 10, and a heat insulation layer may be formed in the partition wall 50 as necessary. One or more shelves 60 may be provided in each of the freezer and refrigerator compartments 12 and 16 to further partition the freezer or refrigerator compartment 12 or 16. One or more storage boxes 62 may be provided in each of the freezer and refrigerator compartments 12 and 16. The storage boxes 62 may slide forward and backward relative to the body 10.

Figure 2:
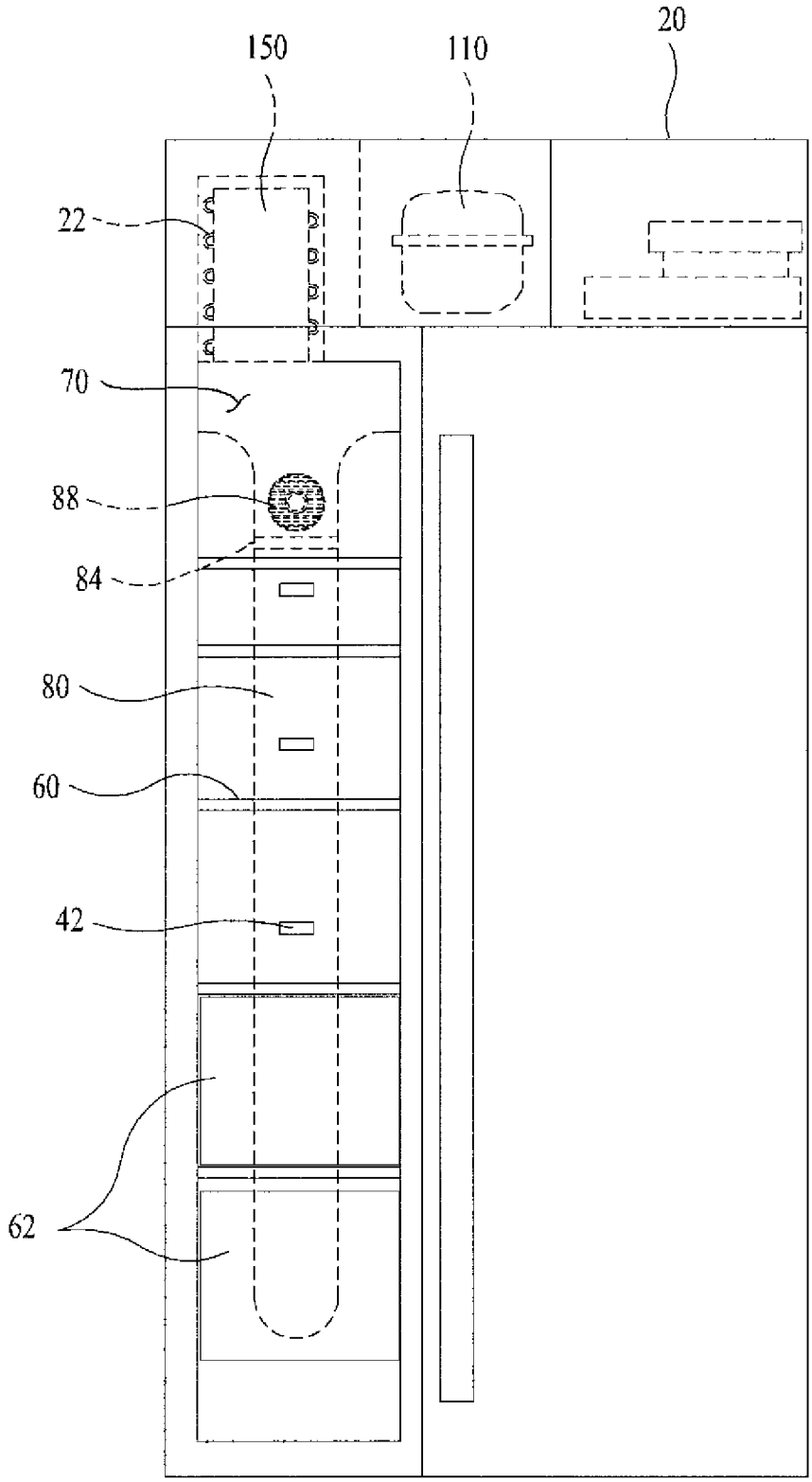
FIG. 2 is a cross sectional view of the refrigerator shown in FIG. 1.

In addition, a quick freezer compartment 70 may be provided in the freezer compartment 12. The quick freezer compartment 70 may be connected with the cold air duct 80 and be nearer to the evaporator 150 than the freezer compartment 12 is, or be positioned between the freezer compartment 12 and the cold air generation chamber 22, as shown in FIG. 2. The cold air generated in the cold air generation chamber 22 may be supplied to the quick freezer compartment 70 to quickly freeze food items stored therein. The quick freezer compartment 70 and the freezer compartment 12 may be sequentially connected with the cold air duct 80 under the cold air generation chamber 22.

In this embodiment, the quick freezer compartment 70 is provided at an upper portion of the freezer compartment 12. Alternatively, the quick freezer compartment 70 may be provided at various other positions in the freezer or refrigerator compartment 12 or 16, as long as it is able to receive cold air more quickly than the freezer compartment 12.

Simply for ease of discussion, a quick freezer compartment provided in the freezer compartment will be discussed hereinafter. However, it is well understood that features as broadly described herein may also be applied to a quick freezer compartment provided in another portion of the refrigerator, such as, for example, the refrigerator compartment, or to a quick cooling compartment provided in either the refrigerator compartment or the freezer compartment.

A panel 72 may be rotatably coupled to a front of the quick freezer compartment 70, in an upward-and-downward or a right-and-left direction, to selectively open and close the quick freezer compartment 70.

The cold air duct 80 may be provided to a rear of the barrier 40 formed at the rear of the freezer compartment 12. The cold air duct 80 may form a path which directs cold air generated in the cold air generation chamber 22 into the quick freezer compartment 70 and the freezer compartment 12. The cold air duct 80 may be connected with the cold air gene ration chamber 22 and in communication with the quick freezer compartment 70 and the freezer compartment 12 via the cold air outlets 42.

Figure 3:
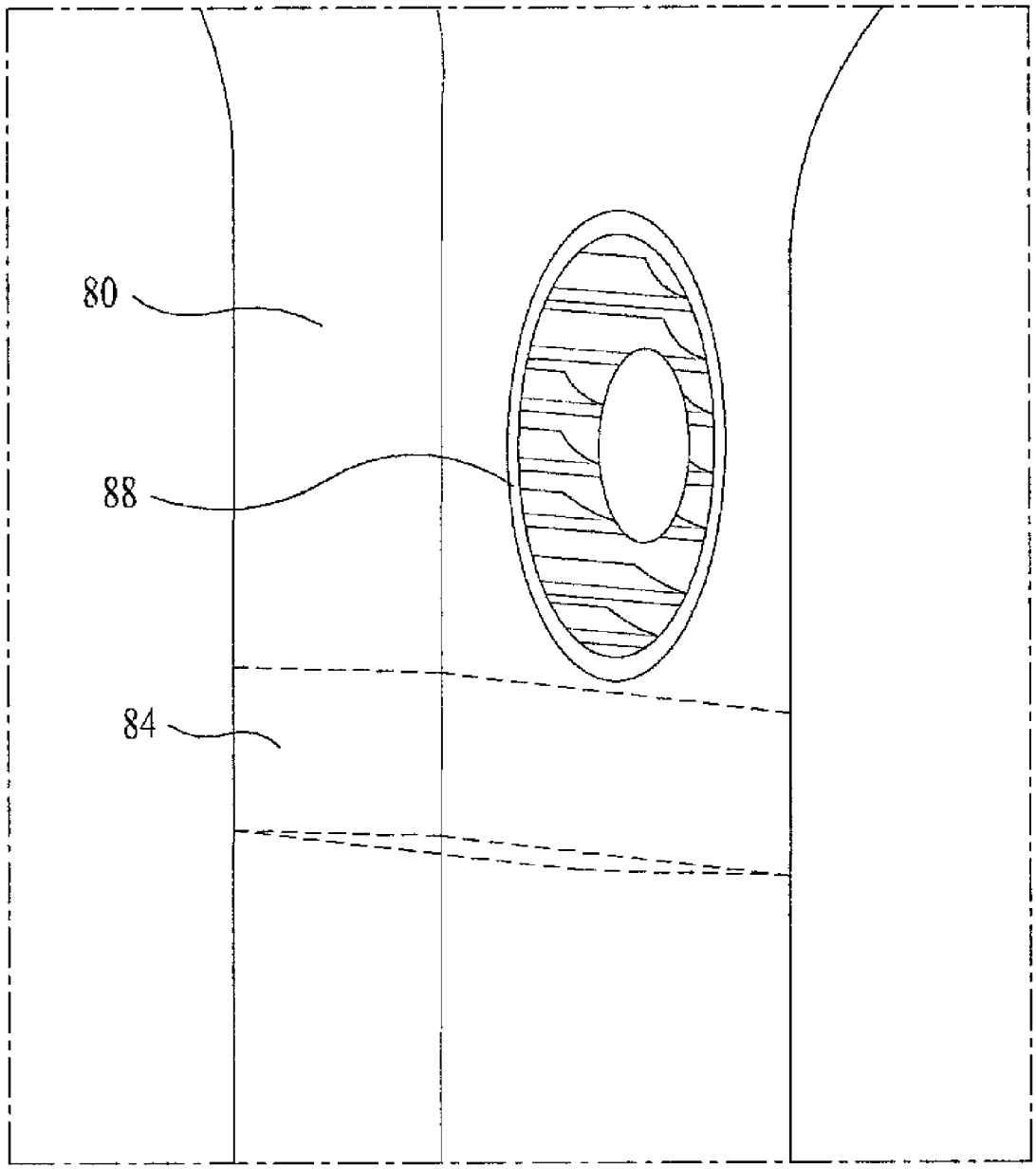
FIG. 3 is a perspective view of a portion of a structure of a cold air duct including a damper and a cooling fan of the refrigerator shown in FIG. 1.

As shown in FIGS. 2 and 3, a damper 84 may be provided in the cold air duct 80. Specifically, the damper 84 may be provided between the quick freezer compartment 70 and the freezer compartment 12 within the cold air duct 80 to shut off the flow of cold air to the freezer compartment 12 and concentrate the flow of cold air into the quick freezer compartment 70. Also, a position of the damper 84 may be controlled to adjust the amount of the cold air that flows into the freezer compartment 12.

A cooling fan 88 may be provided at the portion of the barrier 40 corresponding to the quick freezer compartment 70. Specifically, the cooling fan 88 may be installed in the cold air outlet 42 that provides for communication between the quick freezer compartment 70 and the cold air duct 80, to guide the cold air into the quick freezer compartment 70.

Figure 4:
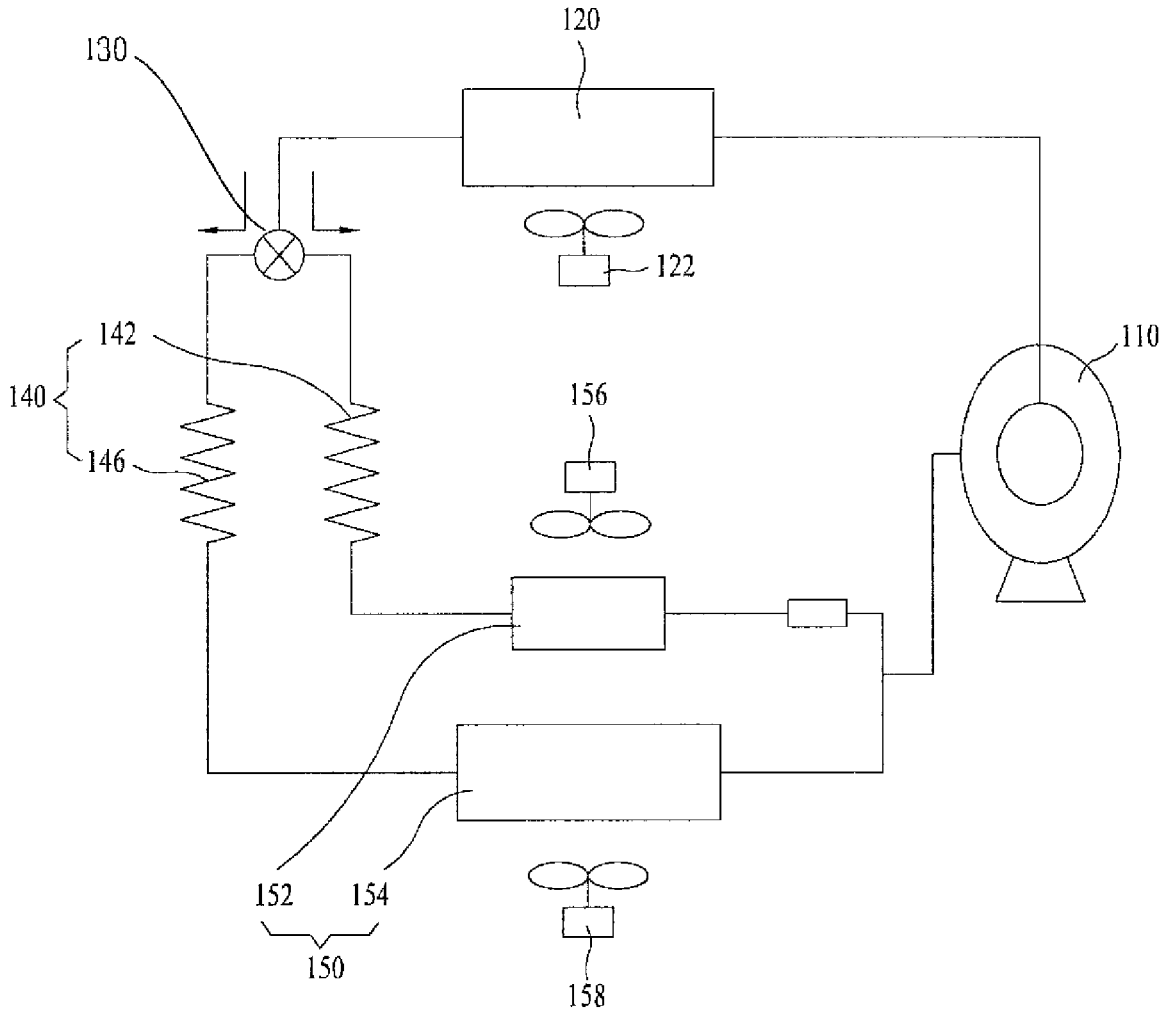
FIG. 4 is a schematic diagram of a cooling cycle of the refrigerator shown in FIG. 1.

As shown in FIG. 4, the cooling cycle may include a compressor 110, a condenser and an expansion valve 140 installed in the mechanism compartment 20, and an evaporator 150 installed in the cold air generation chamber 22.

The compressor 110 compresses a low temperature/pressure refrigerant gas circulating along the freezing cycle into a high temperature/pressure refrigerant gas. The refrigerant having passed through the compressor 110 is drawn into the condenser 120.

The condenser 120 performs heat-exchange of the refrigerant compressed at the compressor 110 with external air to change a phase of the refrigerant such that the high temperature/pressure refrigerant gas becomes a normal temperature, high pressure refrigerant liquid. A refrigerant pipe-shaped tube of the condenser 120 may have a plurality of repeatedly bent portions continuously arranged at a regular interval. An overall appearance of the condenser 120 may be rectangular because of the repeated bent portions of the refrigerant tube. A fan 122 may be installed adjacent to the condenser 120 to blow external air.

The refrigerant having passed through the condenser 120 may be moved to the expansion valve 140 through a 3-way valve 130 that distributes the refrigerant and compresses the refrigerant from the condenser 120 because of its relatively narrow diameter. The expansion valve 140 may include a first expansion valve 142 and a second expansion valve 146. The refrigerant distributed by the 3-way valve 130 may be divided between the first expansion valve 142 and the second expansion valve 146. The refrigerant having passed through the expansion valve 140 is evaporated in the evaporator 150 at a low pressure to absorb heat.

The evaporator 150 may include a freezer evaporator 152 and a refrigerator evaporator 154. The refrigerant having passed through the first and second expansion valves 142 and 146 is drawn into the freezer evaporator 152 and the refrigerator evaporator 154, respectively. A freezer fan 156 and a refrigerator fan 158 may be installed near the evaporators 156 and 158, respectively, to circulate cold air into the cold air duct 80. The cold air generated at the freezer evaporator 152 and circulated in the cold air duct 80 flows into the quick freezer compartment 70 and the freezer compartment 12 based on a position of the damper 84.

Figure 5:
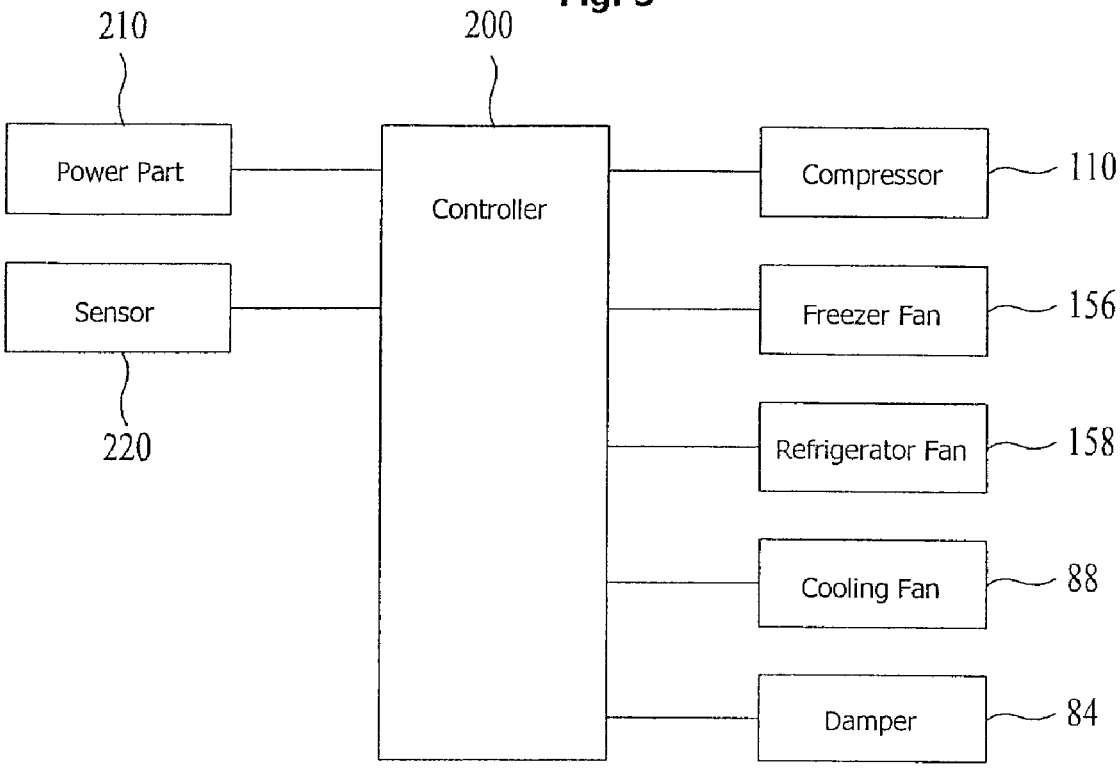
FIG. 5 is a block diagram of cooling components of the refrigerator shown in FIG. 1.

As shown in FIG. 5, a controller 200 may be provided in the refrigerator to control an overall operation of the refrigerator. Specifically, the controller 200 may sense changes in operational environments inside the refrigerator to control an operational state of each element.

An input terminal of the controller 200 may be connected a power part 210 that supplies electricity to the refrigerator and a sensor that senses 220 temperatures of the freezer and refrigerator compartments 12 and 16 and the quick freezer compartment 70. An output terminal of the controller 200 may be connected to the compressor 110, the freezer fan 156, the refrigerator fan 158, the cooling fan 88 and the damper 84 to operate these elements according to a control command of the controller 200.

Next, an operation of a refrigerator having the above configuration will be described in detail.

To initiate a freezing cycle, low temperature/pressure refrigerant gas is changed into high temperature/pressure refrigerant gas by the compressor 110. The refrigerant having passed through the compressor 110 exchanges heat with external air at the condenser 120, and then the heat exchanged refrigerant is directed into the first expansion valve 142 or the second expansion valve 146 by the 3-way valve 130. The 3-way valve 130 may form a refrigerant path toward one of either the first expansion valve 142 or the second expansion valve 146 based on an operational condition of the refrigerator.

The refrigerant having passed through the first expansion valve 142 passes through the freezer evaporator 152 to generate cold air. The cold air generated at the freezer evaporator 152 is blown into the cold air duct 80 by the freezer fan 156 and is drawn into the quick freezer compartment 70 and the freezer compartment 12.

The damper 84 is provided in the cold air duct 80, specifically, between the quick freezer compartment 70 and the freezer compartment 12, to selectively shut off the cold air from being drawn into the freezer compartment 12. For example, the damper 84 may automatically shut off cold air supplied to the freezer compartment 12 if the temperature of the freezer compartment 12 is already below a preset value and the temperature of the quick freezer compartment 70 is over a preset value. The damper 84 may open the cold air duct 80 to allow cold air to flow into the freezer compartment 12 if the temperature of the freezer compartment 12 is over the preset value.

That is, if the temperature of the freezer compartment 12 is below the preset value and the temperature of the quick freezer compartment 70 is over the preset value, the damper 84 supplies cold air to the quick freezer compartment 70 intensively to quickly cool the quick freezer compartment 70. If the temperatures of the freezer compartment 12 and the quick freezer compartment 70 are both below the preset value, an amount of openness of the damper 84 may be controlled to adjust the amount of cold air supplied to the quick freezer compartment 70 and the freezer compartment 12.

If the damper 84 is closed to shut off the supply of cold air to the freezer compartment 12 from the cold air duct 80, the cooling fan 88 may operate to blow cold air into the quick freezer compartment 70.

Figure 6:
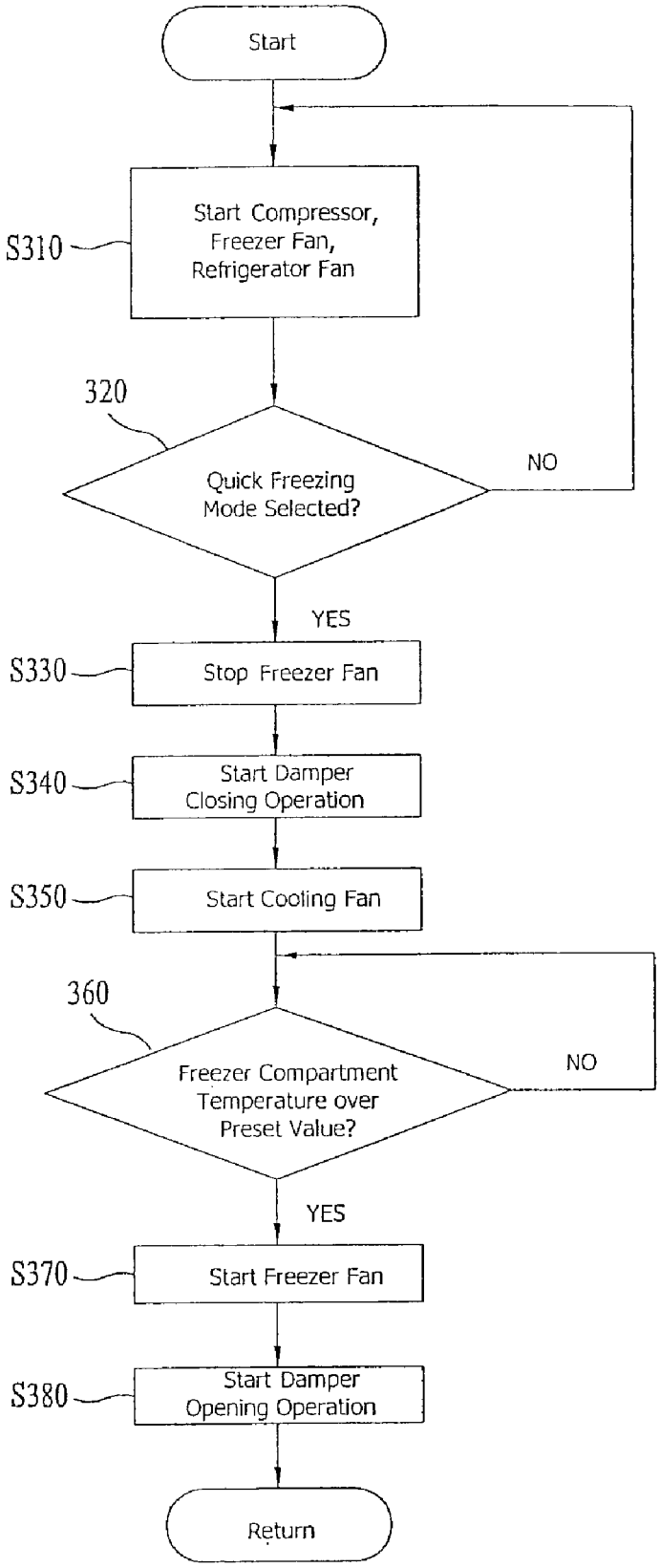
FIG. 6 is a flow chart of a quick freezing mode of a refrigerator as embodied and broadly described herein.

As shown in FIG. 6, once power is applied to the refrigerator, the compressor 110, the freezer fan 156 and the refrigerator fan 158 start to operate (S310) and it is determined whether a quick freezing mode, in which cold air is supplied to the quick freezer compartment 70, has been selected (S320).

If the quick freezing mode has been selected, the freezer fan 156 that guides cold air into the freezer compartment 12 is stopped (S330). Then, the damper 84 is closed to shut off the supply of cold air to the freezer compartment 12 through the cold air duct 80 (S340) and the cooling fan 88 is turned on to guide cold air into the quick freezer compartment 70 (S350).

The sensor 220 provided in the freezer compartment 12 senses the temperature of the freezer compartment 12, and it is determined whether the temperature of the freezer compartment 12 exceeds a preset value (S360). If the temperature of the freezer compartment 12 exceeds the preset value, the controller 200 operates the freezer fan 156 (S370) and opens the damper 84 to allow cold air to flow through the cold air duct 80 and into the freezer compartment 12.

If the temperature of the freezer compartment 12 is at or below the preset value, it is unnecessary to provide further cooling to the freezer compartment 12. As a result, the freezer fan 156 is not operated and the damper 84 is not opened until the temperature of the freezer compartment 12 exceeds the preset value.

As shown in FIG. 7A, if the temperature of the freezer compartment 12 is below the preset value and the quick freezing mode has been selected, the damper 84 closes a predetermined portion of the cold air duct 80 to stop cold air from being drawn down the cold air duct 80 and into the freezer compartment 12. If the cooling fan 88 then starts to operate, cold air is drawn into the quick freezer compartment 70, and cooling is concentrated in the quick freezer compartment 70 to quickly cool the quick freezer compartment 70.

As shown in FIG. 7B, if the temperature of the freezer compartment 12 is above the preset value and the quick freezing mode has been selected, the damper 84 is opened and the freezer fan 156 starts to operate so that cold air may be drawn through the cold air duct 80 and into the freezer compartment 12. The cooling fan 88 may also be operated so that some cold air is supplied to the freezer compartment 12 and some cold air is supplied to the quick freezer compartment 70.

As shown in FIG. 7C, if the quick freezing mode is not selected, the freezing fan 156 starts to operate to blow cold air into the cold air duct 80, and the damper 84 opens the cold air duct 80 to supply cold air to the freezer compartment 12. At this time, the cooling fan 88 does not operate.

In a refrigerator as embodied and broadly described herein, the quick freezer compartment is connected with the cold air duct that supplies cold air to the freezer compartment. As a result, both the freezer compartment and the quick freezer compartment may be cooled simultaneously using a single evaporator.

Furthermore, the damper is capable of selectively closing the cold air duct to selectively supply cold air to the freezer compartment selectively is provided in the cold air duct. As a result, cold air may be intensively supplied to the quick freezer compartment based on an operational condition of the refrigerator.

Still further, the cooling fan is installed between the cold air duct and the quick freezer compartment. As a result, circulation of cold air within the quick freezer compartment may be performed substantially quickly.

A refrigerator is provided.

More specifically, a refrigerator capable of cooling a quick freezer compartment, using cold air circulated into a freezer or refrigerator compartment, and a control method of the same, are provided.

More particularly, a refrigerator capable of guiding the cold air into the quick freezer compartment by selectively shutting off the cold air circulated into the freezer or refrigerator compartment is provided.

A refrigerator as embodied and broadly described herein may include a refrigerator includes a cold air generation chamber provided in a body of the refrigerator, the cold air generation chamber having an evaporator installed therein; a cold air duct forming a path through which cold air generated in the cold air generation chamber is circulated; a freezer compartment having an inner space cooled by the cold air received from the cold air duct; a quick freezer compartment connected with the cold air duct, substantially nearer to the evaporator than the freezer compartment; and a damper installed in the cold air duct to selectively shut off the flow of the cold air flowed to the freezer compartment.

The damper may be provided between the freezer compartment and the quick freezer compartment inside the cold air duct.

A cooling fan may be provided at a predetermined portion in communication with the cold air duct and the quick freezer compartment to guide the cold air into the quick freezer compartment.

The cold air generation chamber may be provided in an upper portion of the body and quick freezer compartment and the freezer compartment may be provided under the cold air generation chamber sequentially.

The damper may automatically shut off the cold air supplied to the freezer compartment, if the temperature of the freezer compartment is below a preset value and the temperature of the quick freezer compartment is over a preset value.

The damper may open the cold air duct, if the temperature of the freezer compartment is over a preset value.

In another embodiment, a refrigerator as broadly described herein may include a cold air duct extended from an bottom of the cold air generation chamber provided in an upper portion of a body; a quick freezer compartment and a freezer compartment sequentially connected with the cold air duct, under the cold air duct; and a damper selectively shutting off the cold air flowed into the freezer compartment to supply the cold air to the quick freezer compartment.

The damper may be provided between the freezer compartment and the quick freezer compartment inside the cold duct.

The refrigerator may also include a freezer fan provided in the cold air generation chamber to circulate the cold air into the cold air duct.

The refrigerator may also include a cooling fan provided in a predetermined portion in communication in the cold air duct and the quick freezer compartment to guide the cold air into the quick freezer compartment.

The damper may automatically shut off the cold air supplied to the freezer compartment and the freezer fan may stop to operate and the cooling fan may start to operate, if the temperature of the freezer compartment is below a preset value and the temperature of the quick freezer compartment is over a preset value.

The damper may open the cold air duct and the freezer fan may start to operate, if the temperature of the freezer compartment is over a preset value.

The cooling fan may start to operate, if the temperature of the quick freezer compartment is over a preset value.

A method of controlling a refrigerator as embodied and broadly described herein may include determining whether a quick freezing mode for supplying cold air to a quick freezer compartment is selected; and supplying the cold air to the quick freezer compartment if it is determined that the quick freezing mode is selected.

The supplying the cold air to the quick freezer compartment may include stopping an operation of a freezer fan guiding the cold air into a freezer compartment; controlling a damper selectively shutting off the cold air guided into the freezer compartment to a cold air duct in communication with the freezer compartment; operating a cooling fan guiding the cold air into the quick freezer compartment.

The method may also include determining whether the temperature of the freezer compartment is over a preset value, using a sensing part provided in the freezer compartment to sense the temperature of the freezer compartment; and controlling the freezer fan to operate and the damper to open the cold air duct, if it is determined that the temperature of the freezer compartment is over the preset value, such that the cold air is supplied to the freezer compartment.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body having a main freezer compartment and an auxiliary freezer compartment formed therein;

a chamber provided in the main body, the chamber having an evaporator installed therein, wherein the auxiliary freezer compartment is positioned closer to the evaporator than the main freezer compartment is;

a duct that connects the chamber, the auxiliary freezer compartment and the main freezer compartment;

a damper installed in the duct at a position between the main freezer compartment and the auxiliary freezer compartment, wherein the damper selectively opens and closes the duct so as to control a flow of cold air to the main freezer compartment;

a freezer fan provided in the chamber to direct cold air from the chamber into the duct; and a cooling fan installed at an opening in the duct leading into the auxiliary freezer compartment and configured to direct cold air from the duct into the auxiliary freezer compartment.

2. The refrigerator of claim 1, wherein the damper is configured to close the duct and restrict the flow of into a lower portion of the cold air duct corresponding to the main freezer compartment when a temperature of the auxiliary freezer compartment is greater than a preset auxiliary freezer temperature and a temperature of the main freezer compartment is less than or equal to a preset main freezer temperature.

3. The refrigerator of claim 1, wherein the damper is configured to open the duct and allow cold air to flow into a lower portion of the duct corresponding to the main freezer compartment when a temperature of the main freezer compartment is less than a preset main freezer temperature.

4. The refrigerator of claim 1, wherein the damper is configured to partially open the duct and allow a portion of the cold air generated in the chamber to flow into a lower portion of the duct corresponding to the main freezer compartment when a temperature of the auxiliary freezer compartment is greater than a preset auxiliary freezer temperature and a temperature of the main freezer compartment is greater than or equal to a preset main freezer temperature.

5. The refrigerator of claim 1, wherein the auxiliary freezer compartment is a quick freezer compartment, and wherein the chamber is provided at a top portion of the main body, the quick freezer compartment is positioned immediately below the chamber, and the main freezer compartment is positioned immediately below the quick freezer compartment such that a temperature of the quick freezer compartment is decreased more quickly than a temperature of the main freezer compartment in a quick freezing mode of the refrigerator.

6. A refrigerator, comprising:

a duct that extends vertically downward from a chamber provided at an upper portion of a main body, the chamber housing an evaporator that provides cold air;

a quick freezer compartment and a main freezer compartment sequentially positioned under the chamber such that the chamber, the quick freezer compartment and the main freezer compartment are connected by the duct;

a vertical barrier wall that defines a rear wall of the quick freezer compartment and the main freezer compartment, and that separates the duct from the quick freezer compartment and the main freezer compartment, the barrier wall including a plurality of openings formed therein through which cold air from the duct flows into the quick freezer compartment and the main freezer compartment;

a damper that selectively restricts a flow of cold air from the chamber into the main freezer compartment so as to concentrate the flow of cold air into the quick freezer compartment;

a first fan provided in the chamber to direct cold air from the chamber into the cold air duct; and a second fan provided in an opening in the barrier wall that corresponds to the quick freezer compartment, wherein the second fan is configured to direct cold air from the duct into the quick freezer compartment.

7. The refrigerator of claim 6, wherein the damper is installed within the duct, at a position between the quick freezer compartment and the main freezer compartment, so as to selectively restrict the flow of cold air into a lower portion of the duct corresponding to the main freezer compartment.

8. The refrigerator of claim 6, wherein the first fan is configured to operate and the damper is configured to close the duct and restrict the flow of cold air into a lower portion of the cold air duct corresponding to the main freezer compartment when a temperature of the auxiliary freezer compartment is greater than a preset auxiliary freezer temperature and a temperature of the main freezer compartment is less than or equal to a preset main freezer temperature.

9. The refrigerator of claim 6, wherein the first fan is configured to operate and the damper is configured to partially open the duct and allow a portion of the cold air generated in the chamber to flow into a lower portion of the duct corresponding to the main freezer compartment when a temperature of the auxiliary freezer compartment is greater than a preset auxiliary freezer temperature and a temperature of the main freezer compartment is greater than or equal to a preset main freezer temperature.

10. The refrigerator of claim 6, wherein the damper is configured to open the duct and allow cold air to flow into a lower portion of the duct corresponding to the main freezer compartment when a temperature of the main freezer compartment is less than a preset main freezer temperature.

11. A method of controlling a refrigerator having a main freezer compartment and an auxiliary freezer compartment, the method comprising:

determining whether a quick freezing mode to supply cold air to the auxiliary freezer compartment is selected; and controlling a position of a damper and supplying cold air only to the auxiliary freezer compartment if the quick freezing mode is selected, comprising:

stopping operation of a freezer fan that guides cold air from a duct toward the main freezer compartment;

moving the damper to shut off a flow of cold air into a portion of the duct corresponding to the main freezer compartment; and operating a fan positioned in a wall of the auxiliary freezer compartment to direct cold air from the duct into the auxiliary freezer compartment.

12. The method of claim 11, further comprising:

sensing a temperature of the main freezer compartment and determining whether the sensed main freezer temperature is greater than a preset main freezer temperature; and operating the freezer fan and opening the damper to allow cold air to flow through the lower portion of the duct and into the main freezer compartment if it is determined that the sensed main freezer temperature is greater than the present main freezer temperature.

* * * * *